US010625323B2

(12) United States Patent
Sohmshetty et al.

(10) Patent No.: US 10,625,323 B2
(45) Date of Patent: Apr. 21, 2020

(54) METHOD FOR MONITORING QUALITY OF HOT STAMPED COMPONENTS

(71) Applicant: FORD GLOBAL TECHNOLOGIES, LLC, Dearborn, MI (US)

(72) Inventors: Raj Sohmshetty, Canton, MI (US); Constantin Chiriac, Windsor (CA); James Engle, Chesterfield, MI (US); Peter A. Friedman, Ann Arbor, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 160 days.

(21) Appl. No.: 15/047,699

(22) Filed: Feb. 19, 2016

(65) Prior Publication Data

US 2017/0239703 A1 Aug. 24, 2017

(51) Int. Cl.

| | |
|---|---|
| ***B21D 22/02*** | (2006.01) |
| ***C21D 1/18*** | (2006.01) |
| ***C21D 11/00*** | (2006.01) |

(52) U.S. Cl.

CPC ..... *B21D 22/022* (2013.01); *C21D 1/18* (2013.01); *C21D 11/005* (2013.01); *C21D 2211/008* (2013.01)

(58) Field of Classification Search

CPC ..... B21D 22/022

See application file for complete search history.

(56) References Cited

U.S. PATENT DOCUMENTS

| | | | | |
|---|---|---|---|---|
| 6,742,374 | B2 | 6/2004 | Ozawa | |
| 2009/0320547 | A1* | 12/2009 | Horton | B21J 13/02 72/342.3 |
| 2011/0068519 | A1 | 3/2011 | Kwon et al. | |
| 2013/0125603 | A1 | 5/2013 | Liu et al. | |
| 2013/0305802 | A1 | 11/2013 | Lee et al. | |
| 2015/0075246 | A1 | 3/2015 | Dorr et al. | |
| 2015/0251246 | A1 | 9/2015 | Reikher et al. | |
| 2016/0326608 | A1 | 11/2016 | Hayashi et al. | |

FOREIGN PATENT DOCUMENTS

| | | |
|---|---|---|
| CN | 102172719 A | 9/2011 |
| CN | 204052647 U | 12/2014 |
| CN | 104942109 A | 9/2015 |

OTHER PUBLICATIONS

The effects of non-isothermal deformation on martensitic transformation in 22MnB5 steel, M. Naderi, A. Saeed-Akbari, W. Bleck, Materials Science and Engineering A 487 (2008) 445-455 (Year: 2008).*

Chinese First Office Action, CN Application No. 201710090632.5 dated Aug. 5, 2019 together with English Translation.

CN 102172719 A, Espacenet English Abstract.

CN 104942109 A, Espacenet English Abstract.

CN 204052647 U, Espacenet English Abstract.

CN First Office Action dated Aug. 5, 2019 for CN Appl. No. 201710090632.5, English Translation.

* cited by examiner

*Primary Examiner* — Scott R Kastler

(74) *Attorney, Agent, or Firm* — Vincent Mastrogiacomo; Brooks Kushman P.C.

(57) ABSTRACT

A controller alters a cycle time of a die arrangement, configured to hot stamp metal into components and having an active cooling system, based on an amount of heat transferred from the components to the active cooling system such that a grain structure of the components transitions from an austenitic state to a martensitic state.

18 Claims, 4 Drawing Sheets

METHOD FOR MONITORING QUALITY OF HOT STAMPED COMPONENTS

TECHNICAL FIELD

The disclosure relates to a hot stamping system and a method for monitoring the quality of components formed in the hot stamping system as well as optimization of the hot stamping system cycle time.

BACKGROUND

The requirements for high security, low weight, and good fuel economy have become increasingly important in automotive manufacturing. To meet all of these requirements, high strength steels have become increasingly popular in vehicle body manufacturing to improve crash behavior and at the same time lower the weight of the vehicle. The high strength steels may be produced at room temperature by cold stamping or at high temperatures at which the material is austenized. The latter process called hot stamping is a nonisothermal forming process for sheet metal, where forming and quenching take place in the same forming step. In comparison to components manufactured by the cold stamping process, hot stamping is capable of providing components having minimum springback, reduced sheet thickness, and superior mechanical properties such as high strength. Yet, hot stamping is a rather complicated process with a variety of process variables. Thus, ensuring that a hot stamping line efficiently produces components of constant quality remains a challenge. Determining whether the formed components achieved the desired metallurgical transformation remains difficult as traditional measuring techniques do not provide accurate information in real time. Yet without this determination, a manufacturer cannot efficiently ensure that the formed components possess the required mechanical properties.

SUMMARY

In at least one embodiment, a hot stamping system is disclosed. The system includes a controller programmed to alter a cycle time of a die arrangement that is configured to hot stamp metal into components and having an active cooling system. The alteration is based on an amount of heat transferred from the components to the active cooling system such that a grain structure of the components transitions from an austenitic state to a martensitic state. Altering the cycle time may include decreasing the cycle time in response to the amount exceeding a threshold amount. Altering the cycle time may include increasing the cycle time in response to the amount being less than a threshold amount. Alternatively, altering the cycle time may include halting operation of the die arrangement. The amount may be based on temperatures and inlet and outlet flow rates associated with the active cooling system. The amount may be based on a temperature or change in temperature of the die arrangement. The amount may be based on a temperature or change in temperature of the components.

In another embodiment, another hot stamping system is disclosed. The system may include a die arrangement including an active cooling system. The system further includes a controller programmed to close the die arrangement to hot stamp metal into a component. The controller may be further programmed to open the die arrangement in response to an amount of heat transferred from the component to the active cooling system exceeding a threshold amount indicative of a phase transformation of the component from austenite to martensite. The controller may be further programmed to keep the die arrangement closed in response to the amount being less than the threshold amount. The amount may be based on temperatures and inlet and outlet flow rates associated with the active cooling system. The amount may be based on a temperature or change in temperature of the die arrangement. The amount may be based on a temperature or change in temperature of the component.

In yet another embodiment, a monitoring method for hot stamped components is disclosed. The method may include altering by a controller a cycle time of a die arrangement that is configured to hot stamp metal into hot stamped components and having an active cooling system. The altering is in response to an amount of heat transferred from the hot stamped components to the active cooling system being indicative of an austenitic to martensitic microstructure transformation. The altering may include decreasing the cycle time. The altering may include increasing the cycle time. The altering may include halting operation of the die arrangement. The amount may be based on temperatures and inlet and outlet flow rates associated with the active cooling system. The amount may be based on a temperature or change in temperature of the die arrangement. The amount may be based on a temperature or change in temperature of the hot stamped components. The amount may be further based on temperatures and inlet and outlet flow rates associated with the active cooling system, a temperature or change in temperature of the die arrangement, or both.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Except where expressly indicated, all numerical quantities in this description indicating dimensions or material properties are to be understood as modified by the word "about" in describing the broadest scope of the present disclosure.

The first definition of an acronym or other abbreviation applies to all subsequent uses herein of the same abbreviation and applies mutatis mutandis to normal grammatical variations of the initially defined abbreviation. Unless expressly stated to the contrary, measurement of a property is determined by the same technique as previously or later referenced for the same property.

Figure 1:
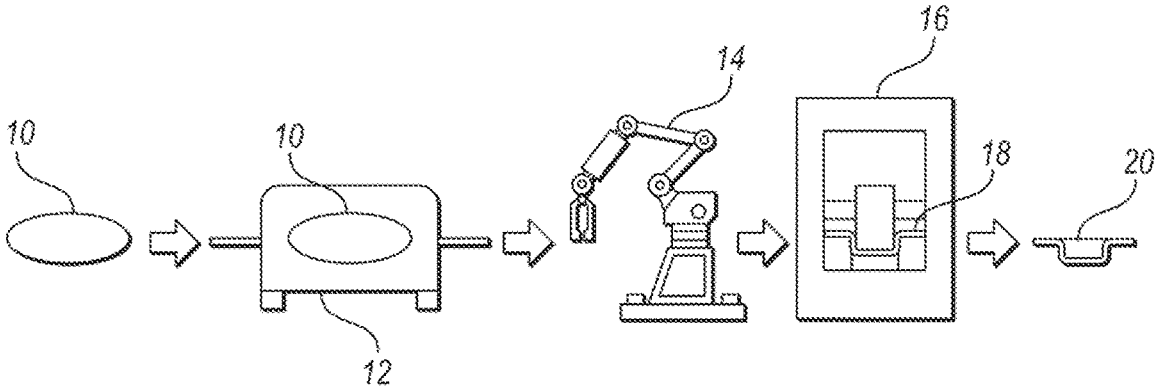
FIG. 1 depicts an exemplary schematic view of a hot stamping process in accordance with one embodiment.

Hot stamping, also called hot forming or press hardening, is a process of forming metal while the metal is very hot, usually in excess of 900° C., and subsequently quenching the formed metal in the closed die. Hot stamping may be direct or indirect. The hot stamping process converts low-tensile-strength metal to a very high-strength metal of about 150 to 230 kilo pounds per square inch (KSI). During a typical hot stamping process, schematically depicted in FIG. 1, a press-hardenable material such as boron steel blank 10 is heated to about 900 to 950° C. to an austenite state in the first stage of the press line or hot stamping system 22. The first stage lasts for about 4 to 10 minutes inside of a continuous-feed furnace 12. A robot transfer system 14 subsequently transfers the austenized blank 10 to a press 16 having a die arrangement 18. The transfer usually takes less than 3 s. A part 20 is formed in the die arrangement 18 from the blank 10 while the material is very hot. The blanks 10 are stamped and cooled down under pressure for a specific amount of time according to the sheet thickness after drawing depth is reached. During this period, the formed part 20, further also referred to as a component 20, is quickly cooled or quenched by being held in a closed die cavity having a water cooling system. Quenching is provided at a cooling speed of 50 to 100° C./s for a few seconds at the bottom of the stroke, which is when the material's grain structure is converted from the austenitic state to a martensitic state. Finally, the component 20 leaves the hot-stamping line at about 150° C. The component 20 has relatively high mechanical properties: tensile strength of about 1,400 to 1,600 MPa (200 to 230 KSI) and a yield strength of about 1,000 and 1,200 MPa (145 to 175 KSI).

The hot stamping process provides numerous advantages over other high-strength steel and advanced high-strength steel forming methods such as cold stamping. One of the advantages is providing stress-relieving capability which resolves problems such as springback and warping typically associated with other high-strength steel forming methods. Additionally, hot stamping allows the forming of complex parts in a single-step die and in only one stroke. Thus, multi-component assemblies can be redesigned and formed as one component, eliminating downstream joining processes such as welding and eliminating the need for additional parts. This may, in turn, reduce overall mass of the formed parts.

Hot stamped parts 20 have found broad application in automotive industry. Typically, hot stamping is best-suited to form components which are required to be both lightweight and strong at the same time. Exemplary automotive components formed by hot stamping include body pillars, rockers, roof rails, bumpers, door intrusion beams, carrier understructure, mounting plates, front tunnels, front and rear bumpers, reinforcement members, side rails, and other auto parts that are required to be strong enough to withstand a large load with minimal intrusion into the passenger compartment during a rollover and impact. The method thus enables producing such components meeting structural performance requirements while adding as little weight to a vehicle as possible.

The hot stamping process is quite complex and thus many process variables exist, thereby creating a need for a robust quality control system. Traditionally, the hot stamping process real time quality monitoring is done by measuring the component temperatures at the beginning and end of the hot stamping cycle. The temperature measurements are typically done using a pyrometer or an infrared camera. Such method; however, has several disadvantages. For example, the infrared camera temperature measurements are relatively inaccurate. Pyrometer, on the one hand, is capable of providing measurements of only one particular location on the component. The temperature in the location could be significantly different than the temperature in other locations on the component. Additionally, the component surface temperature could be different from the component interior temperature, especially in thicker components. An alternative approach for component quality control is a destructive testing. But this approach is time consuming and expensive and hence is done only on a few components.

Thus, obtaining component temperature measurements during the stamping process presents a difficulty. Yet, this information is critical for determination of whether the component has achieved desired temperature and, in turn, the required mechanical properties. It would be useful to determine whether the component has achieved the threshold temperature while the component remains in the die because the components cannot achieve the required cooling rates necessary to complete the transformation once the die is opened and the components are exposed to ambient temperatures. Thus, it would be desirable to know whether and when the components reached the threshold temperature as well as other parameters such as how quickly the components cool, how much the components have cooled, or the like. Having this information would help ensure that components with consistent mechanical properties are being produced. It would be further desirable to have an ability to control and adjust the cycle time of the die arrangement while the component is placed within the die.

Figure 2:
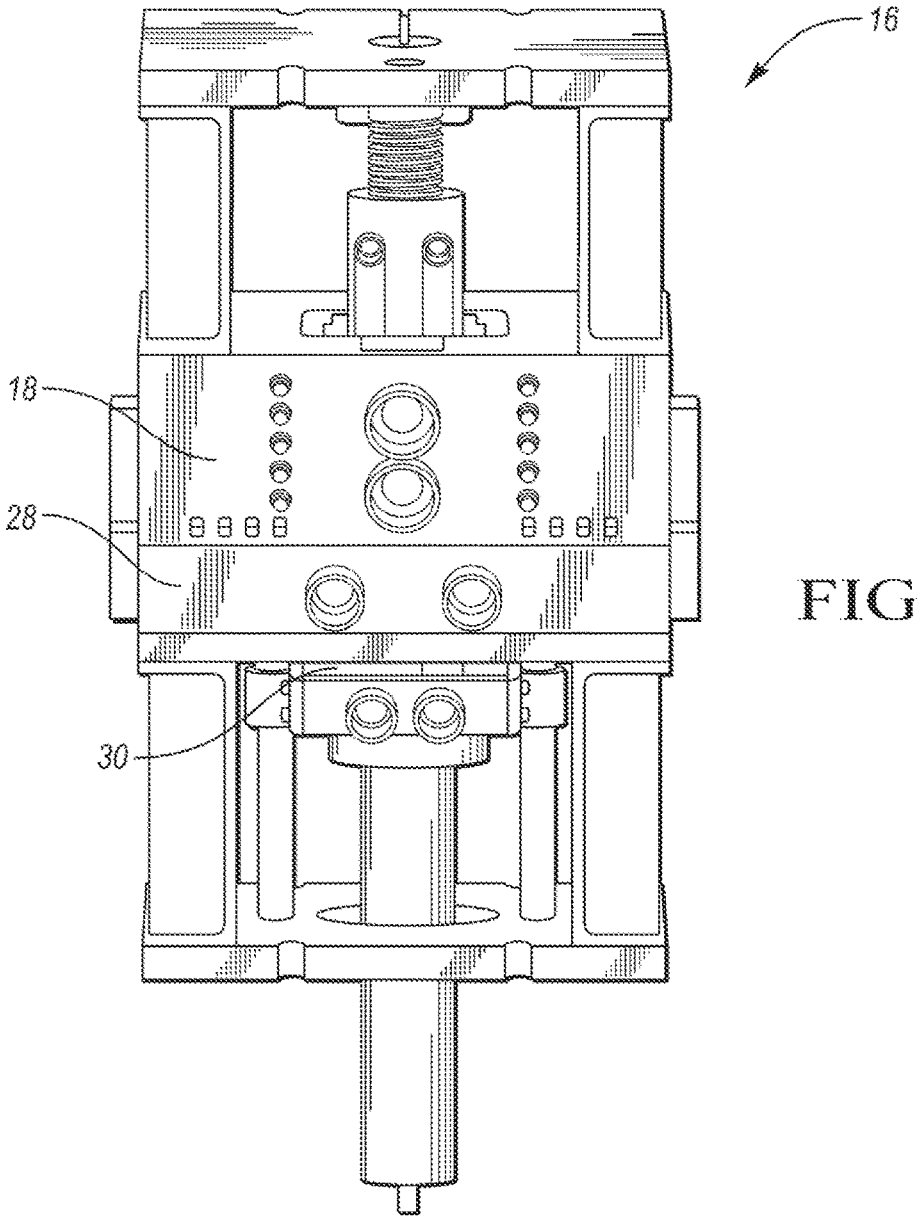
FIG. 2 depicts a schematic perspective side view of an exemplary hot stamping press incorporated in the hot stamping system depicted in FIG. 1.
Figure 3:
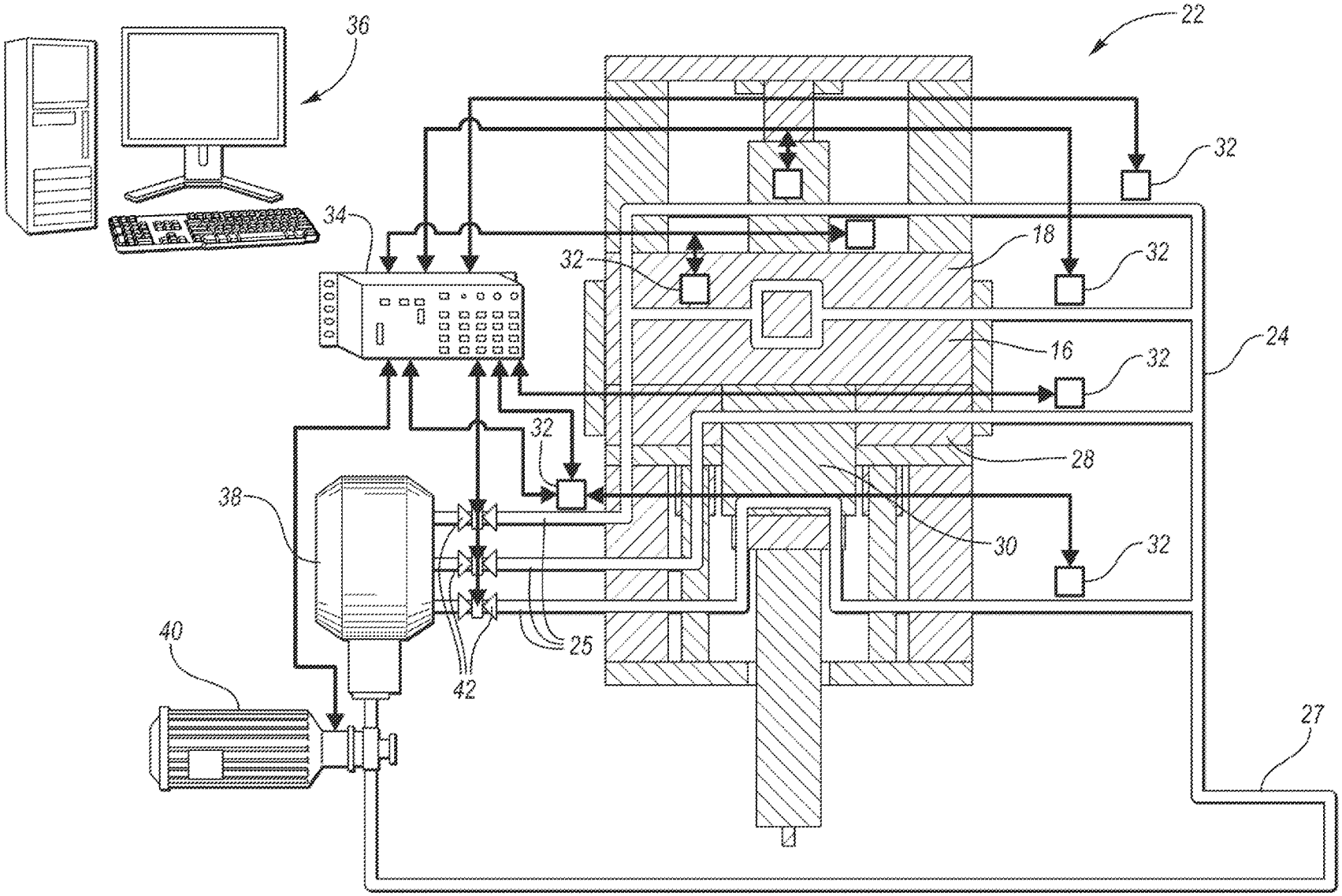
FIG. 3 depicts a schematic side view of a hot stamping system according to one or more embodiments including a cross-sectional view of the hot stamping press depicted in FIG. 2.

According to one or more embodiments, a hot stamping system 22, such as one depicted in FIGS. 2 and 3, is provided for monitoring the amount of heat extracted from each component 20 during the hot stamping process, which was described above. The hot stamping system 22 is useful for both direct and indirect hot stamping. The data then serves for determining whether the required metallurgical transformation has occurred in the component 20 and altering the cycle time of the die arrangement 18 in response to this data, if an adjustment is needed.

The hot stamping system 22 includes a hot stamping press 16. The hot stamping press 16 may be a conventional deep drawing press, a hydraulic or servo press including conventional parts such as the die arrangement 18, a blank holder 28, a punch 30, and the like, depicted in FIG. 2. The press 16 is capable of maintaining tonnage at the bottom of the stroke while the component 20 is being quenched. As can be seen in FIG. 3, the hot stamping system 22 further includes a cooling system 24 providing the quenching. The cooling system 24 may include at least one inlet 25 and at least one outlet 27. The inlet 25 and/or outlet 27 may include multiple cooling channels 26 which may be monitored. To provide an effective cooling system 24, several portions of the press 16 may have to be actively cooled. The portions may include the punch 30, the blank holder 28, and/or the die 18.

In one or more embodiments, the cooling system 24 may include a number of cooling channels 26, incorporated within one or more portions of the system 22 described above, in which the cooling fluid is circulating. Any economically feasible coolant such as water may be used as the cooling fluid within the cooling system 24. The fluid may be supplied from a fluid storage tank 38 with a pump 40 through one or more valves 42. The valves 42 may be controlled by one or more controllers 34. To reach the desirable tensile strength of up to 1600 MPa of the components 20, a complete transformation of the austenitic to martensitic microstructure of the components 20 is required. Therefore, cooling rates faster than 27° C./s in the component must be achieved to avoid bainitic or even ferritic-pearlitic transformation. The cooling channels 26 thus provide rapid cooling at a cooling rate of >27° C./s or about 50 to 100° C./s to the part which results in the components' phase transformation from austenite to martensite at a temperature interval of about 420 to 280° C.

As can be further seen in FIG. 3, the hot stamping system 22 may include sensors 32 monitoring a number of variables such as ambient temperature, die temperature at key measurement locations, cooling system inlet 25 and/or outlet 27 temperature and/or flow rate, incoming and/or outgoing component 20 temperature and/or temperature distribution, the like, or a combination thereof. The sensors 32 may be electronic sensors. The sensors 32 may include single point sensors such as a pyrometer or a sensor monitoring a temperature spectrum such as an infrared camera. Alternatively, the sensors 32 may be thermocouples or other contact sensors. The sensors 32 may be installed at measurement locations on various portions of the hot stamping system 22. For example, a pyrometer may be installed so that a temperature of the blank 10 being loaded into the furnace 12 is monitored. In one or more embodiments, one or more thermocouples may be installed within the die arrangement 18 next to the cooling system 24 so that the thermocouples may monitor inlet 25 and/or outlet 27 temperatures. The sensors 32 may continuously send input signals to the one or more controllers 34.

The one or more controllers 34 are programmed to alter a cycle time of the die arrangement 18 based on an indication of an amount of heat transferred from the components 20 to the cooling system 24. The one or more controllers 34 have one or more processing components such as one or more microprocessor units (not depicted) which enable the controllers 34 to process input data. The input data may be supplied from the sensors 32 and/or a computer system 36 connected to the controllers 34. The input data supplied by the computer system 36 may include component 20 details including component 20 material specification, weight, geometry, and/or thickness. The input data may further include material properties such as the cooling liquid heat capacity, latent heat for phase transformation, and/or phase transformation diagrams. Additional input data may include thermal processing curves for the component 20. This data may be supplied to the controller 34 prior to the hot stamping process, during the process, or both.

The input data supplied from the sensors 32 may include real time die arrangement 18 inlet and outlet flow rates and temperatures, real time die arrangement 18 temperature at predetermined measurement locations, temperature and temperature distribution of the incoming and outgoing component, or a combination thereof. At set intervals, the one or more controllers 34 compare the signal to a predefined set point. If the input signal deviates from the set point, the controllers 34 provide a corrective output signal to one or more portions of the system 22. The one or more portions are responsible for opening the die arrangement 18, closing of the die arrangement 18, halting the hot stamping system 22, the like, or a combination thereof. In at least one embodiment, more than one controller 34 is utilized in the hot stamping system 22. For example, a separate controller 34 may be provided for the hot stamping press 16 and a separate controller 34 may be provided for the cooling system 24. In another embodiment, the inlet 25 and outlet 27 flow data may be collected by controllers 34 independent from the die arrangement controller 34. The one or more controllers 34 may be in communication with one another and/or with other portions of the hot stamping system 22.

Based on the component and material property input data, the controller 34 determines the threshold amount of heat, also called heat extraction target $Q_T$, which is required to be extracted from the die arrangement 18. Based on the real time monitoring input data, the controller 34 calculates the heat extracted from each component 20, also called extracted heat $Q_E$, in real time. Once the steady state of the die arrangement 18 is reached, the controller 34 may effectively determine if the required metallurgical transformation has occurred in the component 20 and thereby whether the required mechanical properties of the component 20 have been achieved. While temperature in the die arrangement 18 does not change once the steady state is reached, changes in ambient temperature may occur. Accommodation may be thus made for changes in ambient temperature once the die arrangement 18 has reached steady state by monitoring the ambient temperature and adjusting calculations. The one or more controllers 34 may process the input data and calculate the threshold amount of heat in every cycle, every other cycle, every third cycle, a random cycle, or the like.

The one or more controllers 34 may dynamically alter a cycle time of the die arrangement 18 based on the indication of the amount of heat transferred from the component 20 to the cooling system 24. The one or more controllers 34 may be further programmed to alter the cycle time by halting operation of the die arrangement 18. If the die arrangement 18 opens and the threshold amount of heat extracted from the die arrangement 18 is not met, the controller 34 may stop the hot stamping system 22. The one or more controllers 34 may then increase the cycle time in response to the amount being less than the calculated threshold amount. Alternatively, the controllers 34 may alter the cycle time by decreasing the cycle time in response to the amount exceeding a threshold amount, thus shortening the holding period of subsequent components 20 within the die arrangement 18. Thus, the cycle time is optimized to produce components 20 having required properties while keeping the hot stamping line or system 22 efficient. If the die arrangement 18 opens and the threshold amount of heat is met, the one or more controllers 34 may be programmed to read real time temperature of the subsequent incoming component 20, calculate heat energy to be extracted for the subsequent component 20, read the inlet and outlet flow rate and temperatures, calculate the amount of heat that has been extracted from the subsequent component 20, or a combination thereof.

In one or more embodiments, the controllers 34 may be programmed to close the die arrangement 18 and in response to indication of an amount of heat transferred from the component 20 to the cooling system 24 exceeding the threshold amount, to open the die arrangement 18. The controllers 34 may be programmed to keep the die arrangement 18 closed until the threshold amount of heat has been extracted from the component 20 within the die arrangement 18. The component 20 thus remains in the die arrangement 18 until $Q_E=Q_T$ or $Q_E>Q_T$. To achieve optimal efficiency of the hot stamping system 22, it is desirable that the component 20 is removed from the die arrangement 18 as soon as the controllers 34 determine that the threshold amount of heat has been extracted from the component 20. This allows for hot stamping cycle time optimization along with component quality monitoring.

The hot stamping system 22 may include further portions such as a furnace 12, upstream of the press, the furnace being capable of heating the blank 10 to a temperature above about 900° C. Since the heated blank 10 is very hot, at least one automated part handling system such as a shuttle or a robot transfer system 14 is provided for transferring the heated blank 10 from the furnace 12 to the hot stamping press 16, from the press 16 into an exit bin, or both. The hot stamping system 22 may additionally include additional stations such as a cleaning unit, trimming unit, a unit for the component 20 cutting, the like, or a combination thereof.

In one or more embodiments, a method is provided for quality monitoring of hot stamped components. The method is applicable to both direct and indirect hot stamping. The method may include determining whether desired mechanical properties of the components 20 have been achieved by determining whether a threshold amount of heat to be extracted from the components 20 has been extracted. The method may further include altering, by a controller 34, a cycle time of a die arrangement 18, configured to stamp blanks 10 into the hot stamped components 20 and having an active cooling system 24, in response to an indication of an amount of heat transferred from the hot stamped components 20 to the cooling system 24.

The step of forming a blank 10 into a hot stamped component 20 in the hot stamping system 22 was described above. The heated blank 10 may be inserted into a stamping die arrangement 18 having a cooling system 24 for a time period. The formed component 20 may be quenched by being held in the closed die arrangement 18 for a period of time.

The method may include entering and/or updating input data relating to the cooling fluid of the cooling system 24, to the hot stamping system 22, to the blank 10, to the component 20, or a combination thereof into a computer system 36. The input data may be supplied to the one or more controllers 34. The input data may be then processed, the heat energy to be extracted from the components 20 may be calculated, and based on the calculated threshold amount, the cycle time may be optimized.

A step of installing one or more electronic sensors 32 at predetermined locations within the hot stamping system 22 for monitoring process variables and providing input data to one or more controllers 34 may be included. The measurement locations for the one or more sensors 23 may be selected based on the required data to be supplied to the controllers 34. The measurement locations such as the inlet and outlet channel or channels 26, the die arrangement 18, or other portions of the hot stamping system 22 may be monitored continuously or discontinuously. The temperature and/or flow rate of the inlet and/or outlet flow channel or channels may be monitored. Additionally, the temperature and/or temperature of incoming and/or outgoing components 20 may be monitored. The stamping die arrangement 18 temperature may be monitored at one or more measurement locations. The data from the sensors 23 may be continuously supplied to the controllers 34. The input signals from the sensors 23 may be received by the controllers 34. The controllers 34 may send output signals to one or more portions of the hot stamping system 22.

The method may include checking if the temperature in the die arrangement 18 is stabilized. Upon reaching steady state, the cycle time of the die arrangement 18 may be altered. The altering may include decreasing the cycle time in response to the amount exceeding a threshold amount. The cycle time may be increased in response to the amount being less than the threshold amount. Altering the cycle time may include halting operation of the die arrangement 18, the hot stamping system 22, or both for a period of time. Upon halting of the operation, the cycle time may be altered to meet the threshold amount of heat to be extracted from the components 20. The operation of the die arrangement 18, the hot stamping system 22, or both may be restarted after optimization of the cycle time.

In one or more embodiments, the method may further include closing the die arrangement 18 and opening the die arrangement 18 in response to an indication of an amount of heat transferred from the component 20 to the cooling system 24 exceeding the threshold amount. The die arrangement 18 may be kept closed in response to an indication of the amount of heat transferred from the component 20 to the cooling system 24 being less than the threshold amount. The die arrangement 18 may remain closed until the threshold amount is met. The controllers 34 may receive input data until the threshold amount is met.

Figure 4:
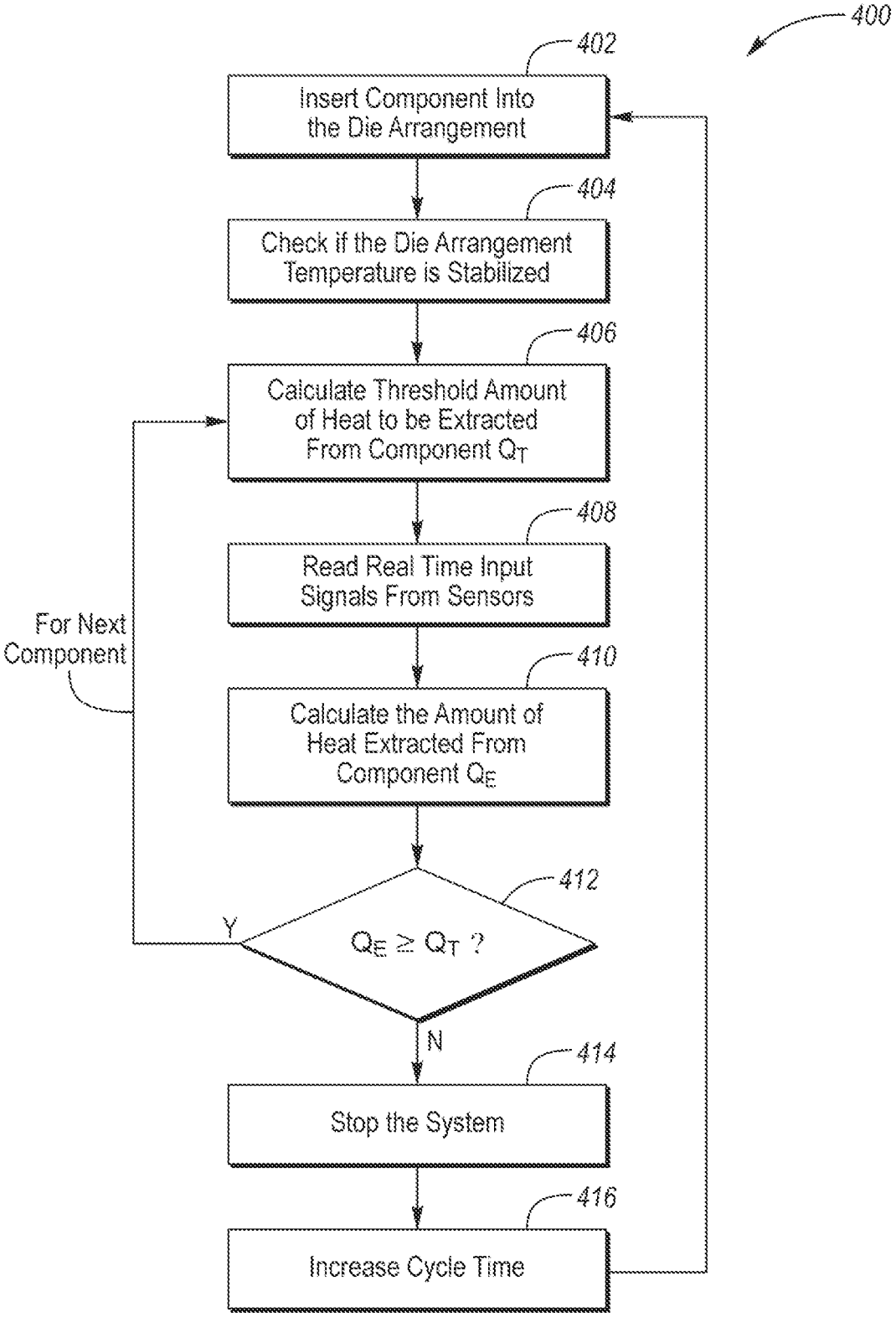
FIGS. 4 and 5 show schematically two series of steps for quality monitoring of hot stamped components and cycle time optimization of the hot stamping system according to one or more embodiments.

FIG. 4 illustrates a method for quality monitoring of hot stamped components 400. The method may begin at block 402, where the controller 34 controls insertion of the blank/component into the die arrangement 18. In one example, the controller 34 transmits a command to one or more subsystems of the hot stamping system 22 to insert the component into the die arrangement 18. The controller 34 checks if the die arrangement temperature is stabilized at block 404 such as by receiving a signal from the sensors 32. The controller 34 then calculates the threshold amount of heat $Q_T$ to be extracted from the component at block 406. Further, at block 408, the controller 34 reads real time input signals from sensors 32, and calculates the amount of heat extracted from component $Q_E$ at block 410. The method may continue at block 412, where the controller 34 assesses whether the $Q_E>Q_T$. The controller 34 stops the system at block 414 and increases the cycle time at block 416, if the answer at block 412 is no. If the answer to $Q_E>Q_T$ at block 412 is yes, the controller calculates the threshold amount of heat to be extracted from component $Q_T$ for the next component.

Figure 5:
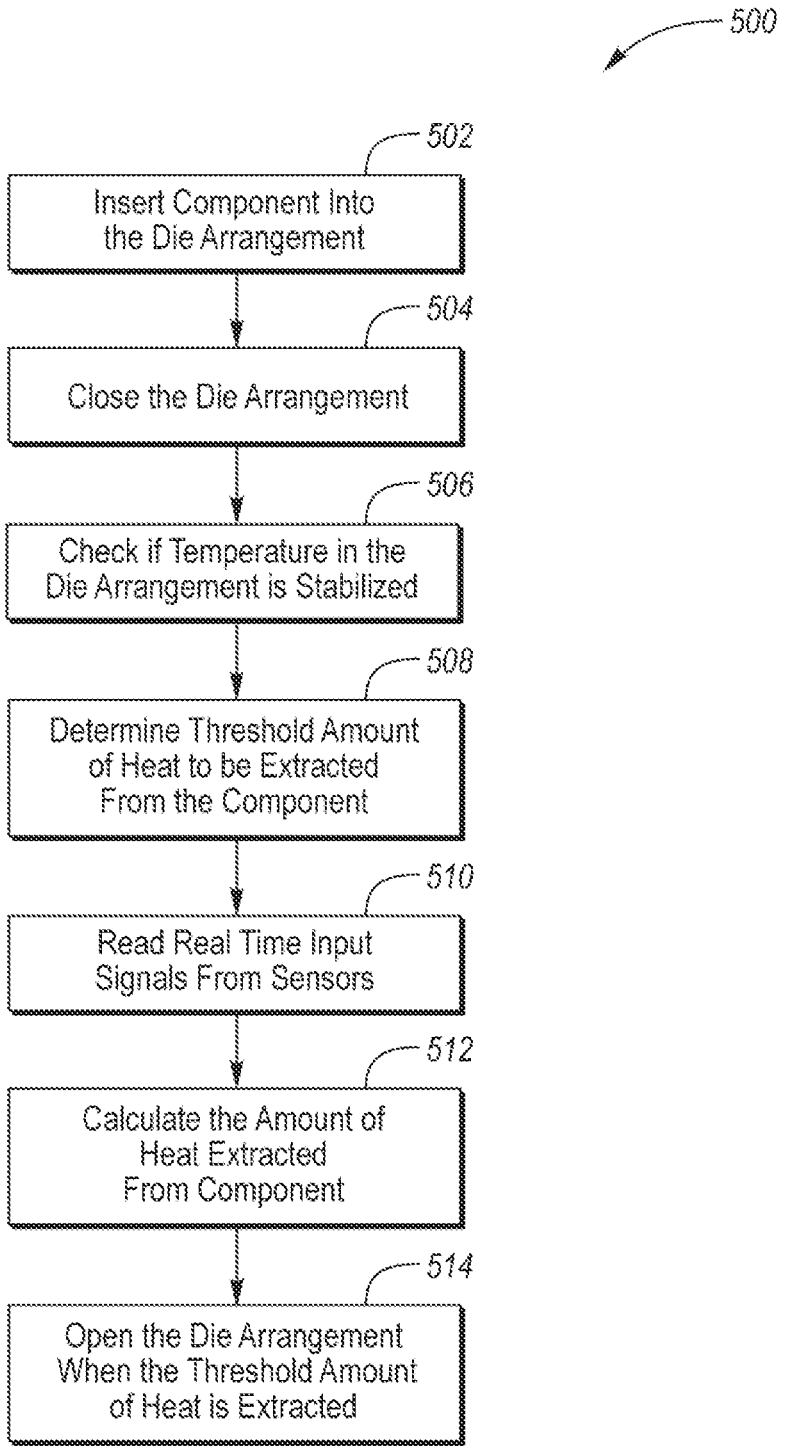

FIG. 5 illustrates another embodiment of the method for quality monitoring of hot stamped components 500. The method may begin at block 502, where the controller 34 directs insertion of the blank/component into the die arrangement 18. The controller 34 further closes the die arrangement 18 at block 504, checks if the temperature in the die arrangement 18 is stabilized at block 506, and determines the threshold amount of heat to be extracted from the component at block 508. The controller 34 further reads real time input signals from sensors 32 at block 510, calculates the amount of heat extracted from the component at block 512, and at block 514 opens the die arrangement 18 when the threshold amount of heat is extracted.

The processes, methods, or algorithms disclosed herein may be deliverable to or implemented by a processing device, controller, or computer, which may include any existing programmable electronic control unit or dedicated electronic control unit. Similarly, the processes, methods, or algorithms may be stored as data and instructions executable by a controller or computer in many forms including, but not limited to, information permanently stored on non-writable storage media such as ROM devices and information alterably stored on writeable storage media such as floppy disks, magnetic tapes, CDs, RAM devices, and other magnetic and optical media. The processes, methods, or algorithms may also be implemented in a software executable object. Alternatively, the processes, methods, or algorithms may be embodied in whole or in part using suitable hardware components, such as Application Specific Integrated Circuits (ASICs), Field-Programmable Gate Arrays (FPGAs), state machines, controllers or other hardware components or devices, or a combination of hardware, software and firmware components.

The words used in the specification are words of description rather than limitation, and it is understood that various changes may be made without departing from the spirit and scope of the disclosure. As previously described, the features of various embodiments may be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. These attributes may include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and may be desirable for particular applications.

What is claimed is:

1. A monitoring method for hot stamping of components, comprising:

by a controller, altering a current cycle time of a die arrangement in response to an amount of heat transferred from a hot stamped component to an active cooling system $Q_E$, and comparing $Q_E$ to a predetermined heat extraction target $Q_T$ indicative of an austenitic to martensitic microstructure transformation, wherein the altering of the current cycle time includes increasing or decreasing the current cycle time or halting operation of the die arrangement.

2. The method of claim 1, wherein the amount of heat transferred is determined by a controller adapted to receive real time input signals from one or more sensors, the input signals including inlet and/or outlet flow rates associated with the active cooling system.

3. The method of claim 1, wherein the amount of heat transferred is determined by a controller adapted to receive real time input signals from one or more sensors, the input signals including a temperature and/or change in temperature of the die arrangement.

4. The method of claim 1, wherein the amount of heat transferred is determined by a controller adapted to receive real time input signals from one or more sensors, the input signals including a temperature and/or change in temperature of the hot stamped component.

5. The method of claim 4, further comprising providing input data comprising a material property of the hot stamped component to the controller.

6. A monitoring method for hot stamped components, comprising:

by a controller, altering a subsequent cycle time of a die arrangement, configured to hot stamp metal into hot stamped components and having an active cooling system, responsive to a comparison of an amount of heat transferred from a current hot stamped component to the active cooling system and a heat extraction target threshold in a current cycle time, wherein the altering of the subsequent cycle time comprises increasing the subsequent cycle time if heat transferred from the current hot stamped component to the active cooling system is lower than the heat extraction target threshold in the current cycle time or decreasing the subsequent cycle time if the heat transferred from the current hot stamped component to the active cooling system exceeds the heat extraction target threshold in the current cycle time.

7. The method of claim 6 further comprising:

by the controller, receiving input data from a sensor, the input data corresponding to at least one of a material specification, weight, geometry, and thickness of the current hot stamped component.

8. The method of claim 6 further comprising:

by the controller, receiving real-time temperature data from a first sensor disposed at a fluid inlet of the active cooling system, and from a second sensor disposed at a fluid outlet of the active cooling system.

9. The method of claim 6, wherein real time monitoring input data is indicative of an amount of heat transferred from a hot stamped component.

10. The method of claim 9 further comprising, by the controller, during the current cycle time, responsive to the amount of heat transferred from the current hot stamped component exceeding the heat extraction target threshold, sending an output signal to the die arrangement.

11. The method of claim 1, wherein the altering of the current cycle time further includes opening the die arrangement.

12. The method of claim 1, wherein the altering of the current cycle time further includes closing the die arrangement.

13. The method of claim 1, wherein the controller is adapted to compare the amount of heat transferred from a hot stamped component to an active cooling system $Q_E$ to the predetermined heat extraction target $Q_T$ at set intervals.

14. The method of claim 1, wherein the controller is adapted to receive real time input signals from one or more sensors.

15. A monitoring method for hot stamped components, comprising:

determining, by a controller, a heat extraction target $Q_T$ from input data;

calculating, by the controller, an amount of heat $Q_E$ transferred from the hot stamped components enclosed in a die arrangement to an active cooling system in fluid communication with the die arrangement;

altering by the controller a cycle time of the die arrangement in response to the amount of heat transferred from the hot stamped components to the active cooling system; and opening the die arrangement when $Q_E=Q_T$ or $Q_E>Q_T$.

16. The method of claim 15, wherein the cycle time is a current cycle time.

17. The method of claim 15, wherein the cycle time is a subsequent cycle time.

18. The method of claim 15, wherein the altering of a current or subsequent cycle time comprises increasing or decreasing the cycle time.

* * * * *